United States Patent [19]

Davies

[11] Patent Number: 4,856,403

[45] Date of Patent: Aug. 15, 1989

[54] STRINGED MUSICAL INSTRUMENT

[76] Inventor: James S. Davies, 702 Blanchard, Seattle, Wash. 98121

[21] Appl. No.: 889,314

[22] Filed: Jul. 22, 1986

Related U.S. Application Data

[63] Continuation-in-part of Ser. No. 699,405, Feb. 7, 1985, now abandoned.

[51] Int. Cl.[4] ..... G10D 3/00

[52] U.S. Cl. ..... 84/291; 84/293

[58] Field of Search ..... 84/267, 291–293

[56] References Cited

U.S. PATENT DOCUMENTS

| | | | |
|---|---|---|---|
| 224,155 | 7/1972 | Smith . | |
| 2,335,244 | 11/1943 | Gugino | 84/293 |
| 2,793,556 | 5/1957 | Maccaferri | 84/267 |
| 3,143,028 | 8/1964 | Fender | 84/293 |
| 3,302,507 | 2/1967 | Fender | 84/267 |
| 3,392,618 | 7/1968 | Pelensky | 84/293 |
| 3,443,018 | 5/1969 | Krebs | 84/293 |
| 3,915,049 | 10/1975 | Bean | 84/1.16 |
| 4,126,073 | 11/1978 | Takabayashi | 84/293 |

OTHER PUBLICATIONS

Guitar Magazine—Aug. 1988.

*Primary Examiner*—Lawrence R. Franklin
*Attorney, Agent, or Firm*—Graybeal, Jensen & Puntigam

[57] ABSTRACT

A stringed instrument having the body (22) including a cutaway (49) adjacent the neck (24) to give access to the entire fretboard (32) while permitting the fretting hand to retain the preferred position with the thumb underlying the fretting fingers. The construction of the neck (24) is such that it is the sole support for substantially the full length of the fretboard.

9 Claims, 6 Drawing Sheets

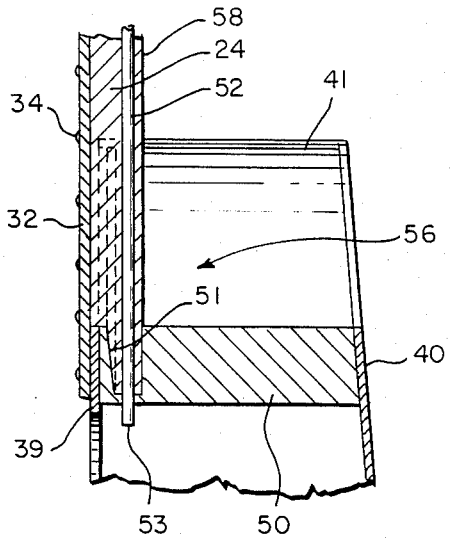
FIG. 9
FIG. 8
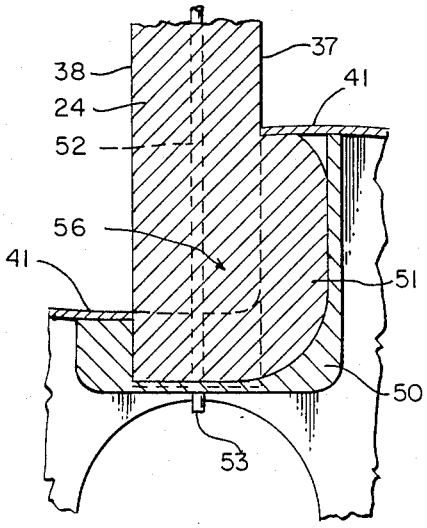
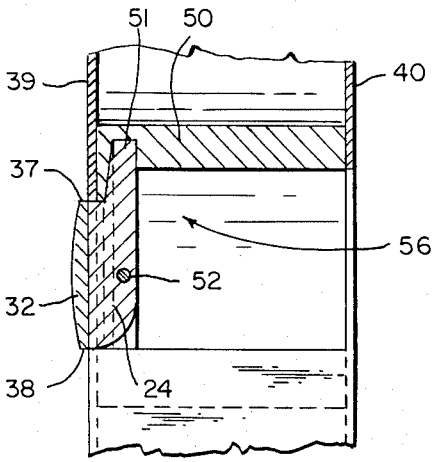
FIG. 10

STRINGED MUSICAL INSTRUMENT

This application is a continuation-in-part of U.S. patent application Ser. No. 699,405 filed Feb. 7, 1985, now abandoned.

TECHNICAL FIELD

The invention relates to the design and construction of stringed musical instruments. Specifically, the invention relates to an improved design and interconnection of the neck and body of a stringed musical instrument creating greater stability and facilitating playability.

BACKGROUND ART

In the most general terms, a musical instrument must perform two functions. It must generate sounds of sufficient volume to be heard assuming an acceptable tone, and it must provide means for these sounds to be manipulated in a manner which accurately represents the musical expression of the player. An instrument serves as a link in a chain, or loop, which begins in the player's mind as a musical concept, is physically transferred to the instrument and returns to the ear as musical expression. It will be appreciated that an instrument will be most satisfactory when it accurately expresses the player's original concept. To this end and of critical importance to an instrument's success, is its interaction with the chosen means of manipulation, be it the hands, feet or mouth of the player. A stringed instrument is played by the hands, and the manner in which the hands "fit" the instrument is one primary concern in the instrument's structure.

A stringed musical instrumentt commonly consists of two parts, a body and a neck, which are joined together to form a whole.

The neck of a stringed instrument such as a guitar, banjo, violin or the like supports one end of a set of tensioned strings, and provides the means for the player's hand to manipulate the strings to form various nodes and corresponding pitches.

The body of the instrument supports the other end of the strings and serves as a soundbox or resonator.

Various stringed instruments are presently available which can selectively produce sounds at different frequencies. In general, sounds in a stringed instrument are produced by causing the strings tto vibrate at a resonant frequency. It is well known that a string of a given length supported at its ends and under tension will vibrate at a specific frequency when excited, producing a single tone. It is also known that if the string is prevented from vibrating at a point along its lenglth, a node will be established at that point and the string will vibrate at a new frequency producing a different tone.

In instruments such as guitars, mandolins and other instruments of the same family, strings are held under constant tension above the instrument nbody and the neck extending from the body. A bridge on the body and a head on the neck provide primary support points or nodes for the strings which may be under different tensions.

A different tone can be produced on each vibrating string by restricting the movement of a string (i.e. forming a node) at any point along the length of the string. The effective shortening of the string is usually accomplished by utilizing a fingerboard or fretboard on the neck beneath the strings and by depressing the string against the fretboard at a single predetermined point.

The initial mode of vibration will thus be suppressed and a new mode or tone produced. The fretboard is normally provided with a plurality of frets which are ridges extending from the surface of the neck to facilitate the formation of a nodal point transverse to the major axis of the neck. The frets are precisely spaced to provide the correct nodal distance between a fret and the bridge to produce a desired pitch.

The body of a stringed instrument supports the neck and the other end of a set of tensioned strings, and provides the means for increasing the volume of the tones generated by the vibrating strings and providing a characteristic timbre or acoustic quality to the sound thus created.

Acoustic guitars rely on a body cavity to cause resonant tones to be produced in the volume of air contained within the cavity and by coupling the vibration of the strings to the body through the bridge and neck. The shape and construction of a guitar body will determine its characteristic timbre by enhancing or diminishing responsiveness to certain frequencies of tone. The volume of air in the cavity will affect the loudness of the instrument, and to some degree the timbre, by effecting a greater or lesser efficiency in transferring energy from a vibrating string into vibrations in air.

The electric guitar utilizes an electromagnetic pickup supported by the body of the instrument which is usually constructed of a solid piece of material, with no air volume contained within. While the electromagnetic pickup is primarily responsible for the volume and timbre of the electric guitar, the body shape and density nonetheless affect timbre by enhancing or diminishing responsiveness to certain frequencies of string vibration.

The guitar, and similar stringed instruments, consist as stated hereinabove, of two separate parts, a body and a neck, which separately perform the two functions of a whole musical instrument, the body producing tones of sufficient volume to be heard, the neck providing means for the manipulation of those tones.

Bringing the two parts of a stringed instrument together to form a functional whole is not without its problems. The traditional geometry as developed in the prior art is reasonably well known.

The body consists of a top and sides and aback to which s joined a neck. The neck comprises a heel joined to the body and at the opposite end a head. The body is shaped into two round bouts, separated by a narrow waist and includes a centrally located soundhole.

A fretboard mounted to the surface of the neck and body has a precise relationship to the string's length, called scale length, such that the twelfth frett will always be at the midpoint of a scale length. A bridge at one end and tensioning machines and a nut at the other end of the fretboard secure the strings and define the length.

The neck and fretboard of a traditional guitar join the body at the twelfth or fourteenth fret from the nut so that the guitar, held with the waist resting on the leg of the player, balances in the player's hands, with one hand near the bridge and the other hand able to reach the end of the fretboard near the head. If the neck joined the body at a higher fret the palyer could not easily reach the notes at the end of the fretboard.

Most guitars have 19–24 frets, with generally at least seven frets overlying the body. Since it is desirable to have access to as many notes as possible, a portion of the upper trebel bout of the body is frequently cut away to allow the hand to move along the treble edge of the neck so as to reach those frets lying over the body. As little of the bout is cut away as possible to avoid diminishing the acoustic properties of the instrument. In this document, when cutaway is spelled as one word, it will refer to the reshaped upper treble bout; when spelled "cut away" it will be used as a verb.

The most serious problems in prior art devices have to do with balancing the conflicting aims of the two functions of a musical instrument—acoustic response and playability. In many prior art instruments a certain amount of playability is sacrificed so as to avoid diminishing acoustic response. Specifically, the body of prior art instruments interferes with the correct positioning of the hand on the neck when playing the highest frets, those which lie over the body of the instrument.

It will be apprciated that the expeditious manipulation of the strings requires critical positioning of the hand. Any change or interference with the hand position will detrimentally affect the facility with which a player can manipulate the strings of the instrument, and will affect the ultimate usefulness and function of the instrument. To fully understand the scope of this interference, it is necessary to precisely define correct hand position.

The player plucks the strings of the instrument near the bridge with one hand and stops them at various frets on the neck with the fretting hand. In order to play with facility the hands should follow the prope form or hand position rules. For the "fretting hand" the generally accepted rules are:

a. The fingers shall play with as little tension as possible.
b. The fingers shall lay across the top portion of the enck perpendicular to the longitudinal axis of the neck (parallel to the frets).
c. Any individual finger should occupy one fret so that four fingers usually occupy four adjacent frets.
d. The thunb should rest on the back of the neck, perpendicular to the axis of the neck, and parallel the fingers.
e. The thumb should be positioned behind or between the position of the first and second fingers, which is to say the plane, perpendicular to the axis of the enck, formed by the thumb should not fall outside the planes, perpendicular to the neck axis, formed by the first and second fingers.
f. The thumb should grasp the neck at a certain point across the neck's width, that point to be determined by the following method:
   The fingers should lay across the top of neck, or fretboard, so that the tip-most knuckle joint of the first finger is over or slightly inside the lowest pitched string, the handheld in a "U" shape.
   The thumb should grasp the neck at this point, approximately three-fourths across the neck toward the bass edge. Note the tip of the thumb is approximately even with the bass edge of the neck (see FIG. 17).
g. Though the fingers may move across the width of the neck to finger one or several strings, the thumb will not generally move (except longitudinally) and will continue to grasp the enck at approximately the same location, so as to provide a "point at reference" for the constantly moving fingers.
h. The wrist should not be bent inward, but should be straight.

These rules are based on the fact that it is the thumb which provides a "fulcrum" for the fingers, and that when the thumb is allowed to oppose the fingers in a comfortable and natural position, the leverage applied by the fingers will be most effective and facile.

It should be noted that some players adopt an altered hand position with respect to these rules, where the thumb grasps the neck further toward the bass edge, so that the tip of the thumb extends past the edge (see FIG. 18). Facility is somewhat diminished in this position, yet it is possible to play when grasping more of the neck. It is, however, virtually impossible to play with facility when the thumb is grasping less than half the neck's width.

A consideration that comes into play is that the humand hand comes in various sizes. These hand position rules then naturally assume that the references only apply when the hand is graspig an appropriately sized neck.

Instrument necks come in a variety of lengths, widths, and thicknesses to accommodate various hands. While the present invention necessarily is referenced to a "standard" consisting of the human hand, it is intended that the reference be made appropriately, i.e., if the fingers on any given hand comfortably and naturally occupy the fretboard on the upper surface of a neck, then the thumb will comfortably and naturally oppose the fingers on the lower surface of the same neck.

A serious disadvantage to all prior art instruments is their inability to allow proper hand position to be maintained throughout the length of the fretboard, causing significant difficulty in playing certain frequencies or tones. This disadvantage is caused by two factors in the construction of these instruments.

The first factor relates to the traditional construction of the heel portion at the base of the neck. The heel is an extension from the underside of the neck, at the base thereof, to attach the neck to the body and to provide support for the neck. The fretboard usually extends beyond the base of the neck and onto the body of the instrument, thereofre, the production of high-frequency notes (corresponding to relatively short nodal distances on the string) requires the depression of a string, to create a node, at a point on the fretboard or neck which is directly above a portion of the heel. The end of the heel prevents the thumb from assuming a correct position opposite the fingers which causes the entire hand to assume a contorted, incorrect position. The distorted position results in a decreased facility in playing the higher frequency tones relative to notes played on other portions of the neck where proper hand positions are easily achieved.

A second factor relates to the shape of the body of acoustic guitars and other acoustic stringed instruments. These instruments rely on a body cavity to "create" the loudness and timbre of the instrument. The traditional shape of the body itself interferes with the correct positioning of the hand on the fretboard position which lies over the body.

The problem is how to improve the second function of a musical instrument (playability) without negatively affecting the primary function (acoustic response). It would be relatively simple to extend the playable range of an instrument by simply cutting away more of the body and lengthening the neck, if one were willing to sacrifice the characteristic sound. It is desirable to improve the playability of the instrument without changing the sound.

Complicating this esoteric problem are mechanical considerations which relate to structural integrity structure must bring together playability and acoustic response in one instrument, ideally without one aspect diminishing the other. The acoustic response of an instrument is greatly improved by making the body light and therefore more responsive to the oscillations of the strings. The strings exert a great amount of tension (100–250 ft/lbs) and dimensional stability is enhanced by massive, solid construction. The neck should be as stable as possible to resist deformation caused by string tension. The fretboard must be very straight and level so that the strings may be set as close to the neck as possible, reducing the bending moment generated by the strings.

In conventional guitar designs, the top, sides and back of the body are connected to a heel block, the heel block is then connected to the heel of the neck. Thus, the heel block functions as an intervening member between the body of the instrument and the neck. The fretboard is applied over these elements, typically extending over the neck, the heel block and a portion of the top. Thus, the fretboard is supported by three distinct individual structures. Lying partly over the neck and partly over the body and heel block, the fretboard is frequently distorted by differing expansion and other internally generated stress in the members supporting it. The fretboard, therefore, does not maintain linear alignment.

The neck of such an instrument is usually provided with a truss rod tensioned between the free end of the neck and the heel of the neck. The truss rod serves to counteract the torque on the neck generated by the stringsn so that a flat surface is maintained for the fretboard. Since the fretboard typically extends beyond the heel of the neck, over the heel block and over an unsupported portion of the top of the body, the truss rod cannot maintain a substantially planar surface for mounting the fretboard. Thus, the fretboard may be subject to bending along a portion thereof not directly supported by the neck.

DISCLOSURE OF THE INVENTION

It is an object of the invention to provide a stringed musical instrument with a unique neck/heel design which allows correct hand position while playing the highest frequency nots on the fretboard.

It is an object of the invention to achieve the playing facility without significantly altering the tonal response of the instrument, by not requiring major changes in the body shape or the air volume contained within the body.

It is also an object of the invention to improve the dimensional stability of a stringed instrument, particularly regarding the fretboard.

It is a further object to provide counteracting tension along the entire length of the fretboard to maintain the linear alignment of the fretboard.

Basically the invention achieves the above noted objectives by having a neck heel which is offset from the longittudinal axis of the neck to provide a recessed area beneath the neck under that portion of the neck and fretboard which lie over the body of an instrument. The body of the instrument has a cutaway (wherein part of the upper treble bout is reshaped by eliminating that part of the bout which prevented a hand from moviong along the treble side of the neck). This recessed area extends across and beyond the entire width of the neck so that the thumb may assume the correct position opposite to and in the same plane as the fingers when grasping the neck.

There is not teaching wherein it is possible to maintain current hand position while playing the fretboard portion lying over the body. The thumb and/or hand must be moved to an altered, unfamiliar position by the presence of the heel, violating hand position rules D, E, F, and G as stated above (see FIG. 18).

The prior art known to the present inventor includes: U.S. Pat. No. 2,335,244 granted to Gugino on Nov. 30, 1943 deals with the issue of a stable fretboard but does not address the issue of hand position.

U.S. Pat. No. 2,478,136 granted to Stromberg on Aug. 2, 1949 teaches the concept of an adjustable rod mounted within the neck of the stringed instrument for improving the stability thereof.

U.S. Pat. No. 2,498,926 granted to Mitchell on Feb. 28, 1950, while providing an instrument which increases finger dexterity does not permit appropriate placement of the thumb.

U.S. Pat. No. 3,091,150 granted to Sceusa on May 28, 1963 addresses the problem by reducing the number of frets so that none of them overlie the body.

U.S. Pat. No. 4,291,606 granted to LePage on Sep. 29, 1981 does in fact modify the body of the instrument to provide more easy access to the hand of the front board but does not address the structure of the device nor the positioning of the thumb.

It should be remembered that avoiding any changes whatsoever from the stated hand position rules is an object of the present invention. Applicant does not claim to be the first to have reshaped a body to allow more access to the upper fretboard, or to have reduced the heel dimensions to allow more thumb room. Applicant does not claim to be the first to devise a heel which allows truly complete and unrestricted room for the thumb, so that the hand need not assume incorrect form or change position from that stated rules whatsoever in the upper fretboard.

BRIEF DESCRIPTION OF THE DRAWINGS

FIG. 8 is a sectional bottom view plan detail of the heel/body junction of the instrument taken along line 8—8 of FIG. 7.

FIG. 9 is a sectional side elevational detail of the heel/body junction of the instrument taken along line 9—9 of FIG. 6.

FIG. 10 is a sectional end detail of the heel/body junction taken along line 10-10 of FIG. 6.

BEST MODE FOR CARRYING OUT THE INVENTION

Referring now in detail to the drawings, the numerals herein refer to like numbers in the figures.

Figure 1:
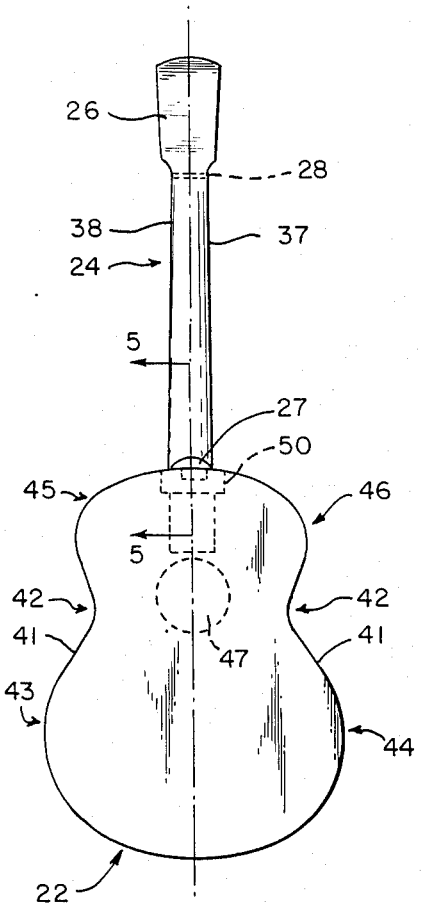
FIG. 1 PRIOR ART
FIG. 1 is a bottom plan view of a conventional instrument, without a cutaway, not employing the improved heel desing.
Figure 2:
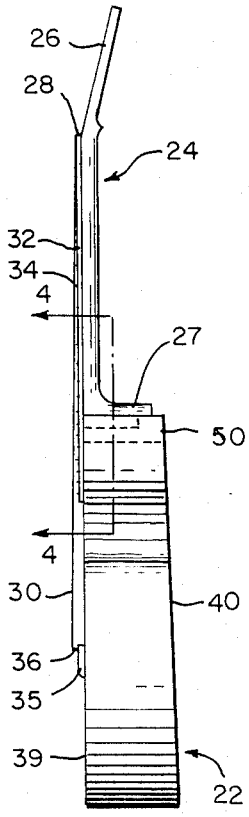
FIG. 2 PRIOR ART
FIG. 2 is a side elevational view of the conventional instrument shown in FIG. 1.

In FIGS. 1 and 2, a conventional instrument, not employing the improved neck. The instrument includes a body 22 and neck 24. The neck 24 includes an integral head 26 and heel 27. The head generally serves to support the nut 28, which serves as a nodal point at the end of the fretboard for the strings 30, and anchors the conventional tuning machines (not shown). The fretboard 32 is supported on the enck and body, extending from the nut, down the length of the neck, and over part of the body. The fretboard has transverse frets 34, which protrude from the surface of the fretboard to provide various nodal points for the strings when depressed on or near a fret. The frets are spaced in the conventional manner. A bridge 35 having a saddle 36 provides a commons econd nodal point for all the strings. As is conventional, the bass strings are on the side of fretboard closest to the head of the player (the right side as viewed from the bottom view of FIG. 1) and the treble strings are on the opposite side of the neck. The neck thus has a bass side edge 37 and a treble side edge 38.

The body 22 has a top 39, a back 40, and sides 41, connected at their respective edges to enclose a volume of air. The sides are bent so as to describe the traditional "FIG. 8" outline of the instrument. The outline narrows at the waist 42, widening into circular upper and lower lobes, or bous, 43, 44, 45, 46. As the strings 30 are arranged according to higher or lower pitch, the bouts are named according to whether they fall on the side of the proximal tot the highest or lowest pitched string. The lower treble bout 43 and the upper treble bout 45 are proximal to the highest pitched string, the lower bass bout 44 and upper bass bout 46 are proximal to the lowest pitched string. Located on the top, near the waist area, is a soundhole 47.

Figure 3:
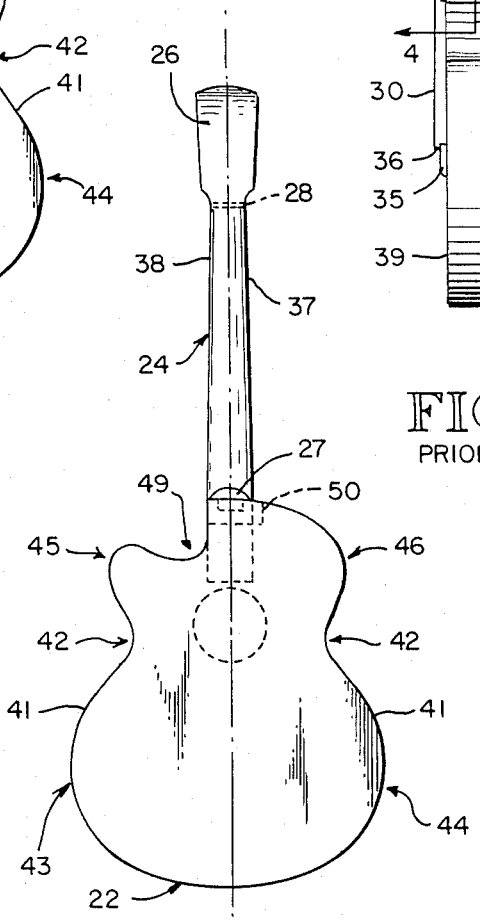
FIG. 3 PRIOR ART
FIG. 3 is a bottom plan view of a conventional instrument, with a cutaway, not employing the improved heel design.

FIG. 3 shows a conventional instrument alike in all respects to the instrument shown in FIGS. 1 and 2 except that part of the upper treble bou is reshaped to form a cutaway 49, eliminating that part of the bout which would not allow a hand to slide along the treble side of the neck to reach that portion of the fretboard which falls between the heel and soundhole.

Figure 4:
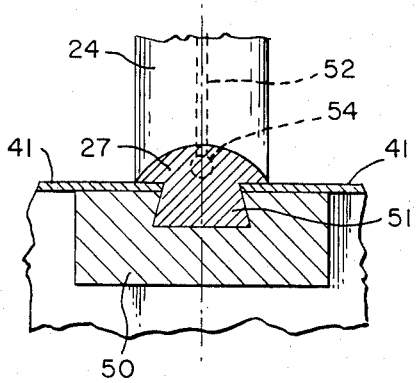
FIG. 4 PRIOR ART
FIG. 4 is a sectional bottom plan detail along line 44 of the instrument shown in FIG. 2.
Figure 5:
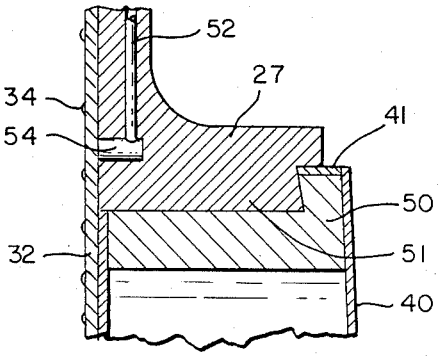
FIG. 5 PRIOR ART
FIG. 5 is a sectional side elevational detail taken along 5—5 of FIG. 1.

A detailed illustration of conventional heel construction is shown in FIGS. 4 and 5. These figures show the neck 24 joined to the heel block 50. The heel block 50 is joined to the sides 41, the top 39 and back 40 of the body. Into the heel block is cut a slot or mortise which will accept tenon 51 cut on the end of the heel 27. As a mortise and tenon joint achieve its strength from where the side of the mortise and tenon overlap, note that the primary gluing surfaces are perpendicular to the instrumentn top. A truss rod 52 is shown with one end 54 anchored in the heel. As is conventional, the rod extends to the end of the fretboard at the head portion of the neck (not shown) where it is tensioned, generally with a threaded nut, so as to counteract the tension on the neck caused by the strings.

Figure 6:
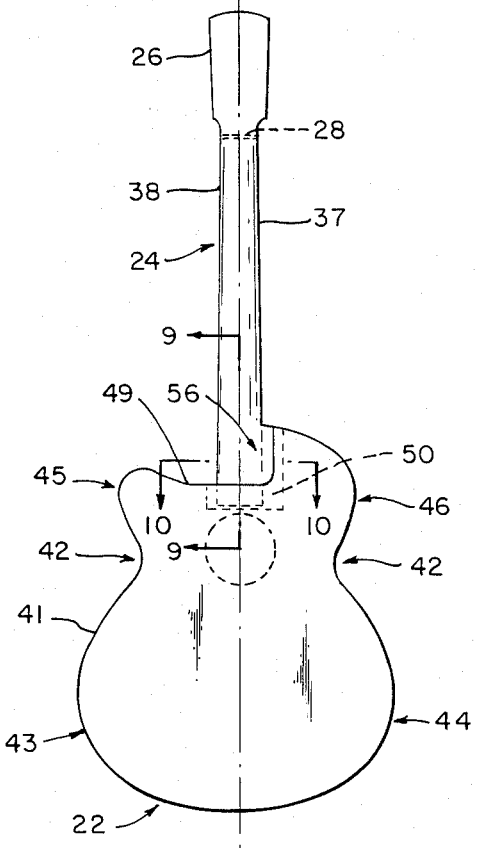
FIG. 6 is a bottom plan view of an instrument employing the improved heel design.
Figure 7:
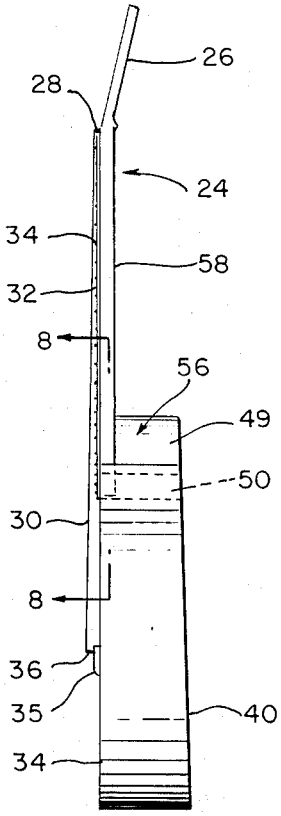
FIG. 7 is a side elevational view of the instrument in FIG. 6.

FIGS. 6 and 7 show an improved acoustic stringed instrument in accordance with the present invention. The instrument has a body 22 with a cutaway 49 and a neck 24 with an integral head 26. The heel portion of the neck is elongated and is constructed so a transverse recess 56 is located where a conventional heel would be, allowing a thumb to be placled against the back surface 58 of the neck while the opposed fingers depress the strings 30 against the frets 34 on that portion of the fretboard 32 located above said recess.

Construction of the instrument in this manner permits proper coplanar thumb and finger positioning to be maintained throughout the entire length of the fretboard allowing the highest frequency notes to be played with facility and dexterity.

Furthermore, construction of the transverse recess 56 requires very little change in the shape of the body 22 or the magnitude of the volume of air enclosed within as compared to a conventional instrument with a cutaway, minimizing any variation in tonal quality. Based on a calculation of the volume contained therein, FIG. 6 loses only 5 percent of the volume of air contained in FIG. 3.

A detailed illustration of the neck/body junction is shown in FIGS. 8, 9 and 10. FIG. 8 is a sectional bottom plan view showing the neck 24 joined to the heel block 50. The heel block 50 is joined to the side 41 andn top 39 and back 40 of the body. Into the heel block is cut a mortise which will accept a tenon 51 cut on the neck 24.

Note that this construction relocates the mortise and tenon to a unique position. As FIG. 10 shows, rather than extending vertically from the back surface 58 of the neck, perpendicular to the top 39 of the instrument, as in conventional construction, the gluing surfaces extend to the side of the neck 24 and are essentially parallel to the plane formed by the top 39. This relocation of the mortise allows the transverse recess 56 to extend across the entire widtth of the neck 24 and beyond the bass edge side 37 of the neck, allowing the thumb to transversely occupy the same position it would on that portion of the neck not proximal to the body.

Additionally, FIGS. 8, 9 and 10 show the neck 24 and a truss rod 52 with a tensioned end 53. The truss rod 52 is conventional in all respects but one; rather than being terminated at the position of the conventional heel (as shown in FIG. 4 and 5), it extends from the end of the fretboard near the head (not shown) the entire length of the improved elongated neck, thereby providing counteracting tension along the entire fretboard. Although a portion of the top 39 and heel block 50 intervene between the neck and fretboard near the last fret, those members will not diminish the support for the fretboard provided by the improved neck since the parts are essentially layered parallel with the plane formed by the fretboard. The truss rod may be anchored at either end and tensioned at the opposite end by conventional means.

An instrument built in accordance with the present invention thus has a fretboard 32 supported along its entire length by the neck 24 and truss rod 52. This eliminates conflicting stresses which occur in conventional constructiton where the fretboard is supported by three separate distinct elements - neck, heel block and top. Counteracting tension from the truss rod of a conventional instrument does not support the entire length of the fretboard. By mounting the fretboard so as to be supported along its entire length by the counter-tensioned neck, the fretboard can be maintained in linear alignment throughout its entire length, providing excellent dimensional stability and superior playability.

Figure 11:
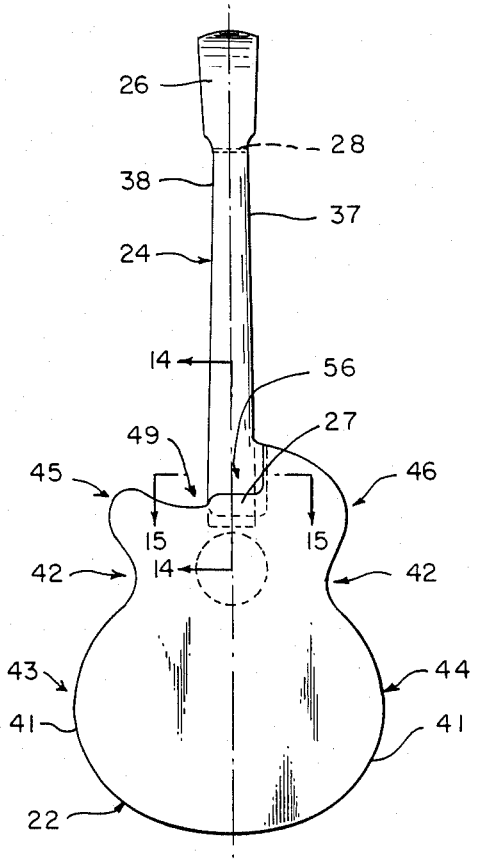
FIG. 11 is a bottom plan view of an instrument employing the improved heel design, using an alternative method of construction.
Figure 12:
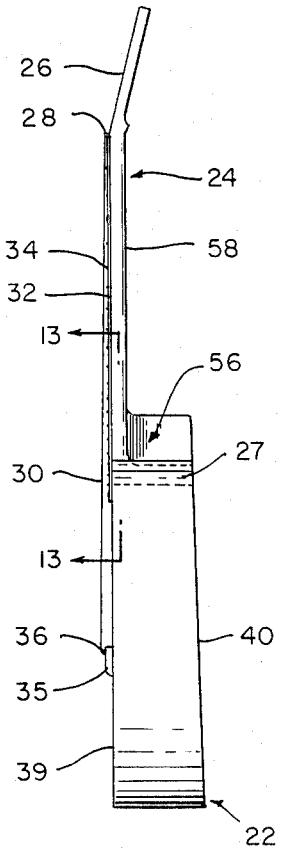
FIG. 12 is a side elevational view of the instrument employing the improved heel design shown in FIG. 11.

FIGS. 11 through 15 show an alternate means of constructing an instrument in accordance with the present invention. FIGS. 11 and 12 show an instrument with a body 22, a cutaway 49, and aneck 24 with an integral head 26 and an integral heel 27. The heel is elongated and is constructed with a transverse recess 56 located where the conventional heel would be, again allowing the thumb to occupy the back surface 58 of the neck.

Figure 13:
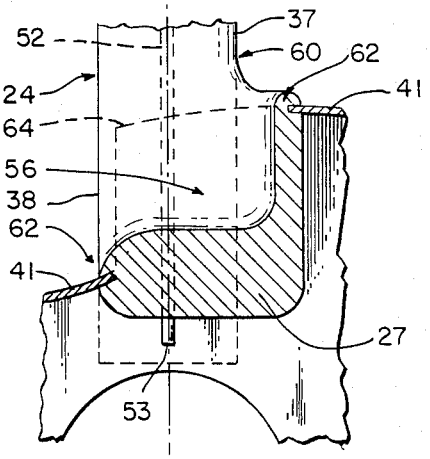
FIG. 13 is a sectional bottom plan detail of the heel/-body junction of the instrument taken along line 13—13 of FIG. 12.
Figure 14:
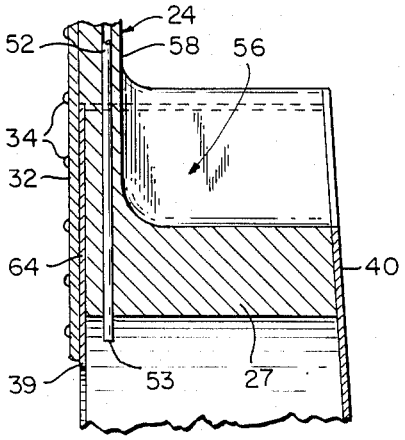
FIG. 14 is a sectional side elevational detail of the heel/body joint of the instrument taken along line 14—14 of FIG. 11.
Figure 15:
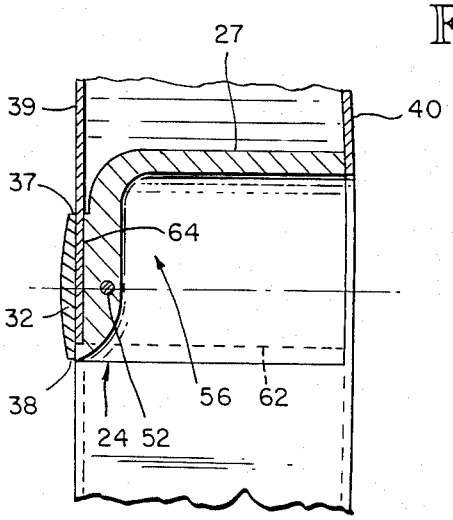
FIG. 15 is a sectional end detail of the heel/body junction of the instrument taken along line 15—15 of FIG. 11.

FIGS. 13, 14 and 15 show in detail the neck/body junction. FIG. 13 is a sectional back plan view showing the neck 24 and heel 27 with a transverse recess 56. The heel 27 is shaped to eliminate the need for a heel block, by allowing the neck heel to join directly to the sides 41, top 39 and back 40 of the instrument. To permit this interconnection, the heel 27 is shaped so it curves in two directions. FIG. 13 shows the heel 27, that portion which having extended from the bass side edge 60 of the neck and curving downward, perpendicular to the top, having a mortise 62 near the bass edge 37 of the neck, to accept the side 41 of the upper bass bout, said offset portion of heel continuing parallel the longitudinal axis of the neck, then curving transversely across the end of the neck, terminating at the treble edge 38 of the neck, where a mortise 62 accepts the side 41. The flat upper surface of the neck 24 has a rabbett 64 to accept the top 39 under that portion of the fretboaord 32 which lies over the body 22.

FIG. 15, a sectional end view, shows the heel 27 extending from the bass side edge 60 of the neck, parallel to the instrument top 39, then curving downward, becoming perpendicular to the top 39, and continuing downward to the back 40.

Although a portion of the fretboard is thus attached to the top, the fretboard and top are both supported by the neck andthe top intervening bettween fretboard and neck in this manner will not diminish the support for the fretboard. Thus, the entire length of the fretboard, to within the last fret, remains supported by the neck 24 and truss rod 52, havingn a tensioned end 53, and is maintained in linear alignment.

An instrument constructed in accordance with this approach would reduce the volume of air within the body of approximately 3%.

Figure 16:
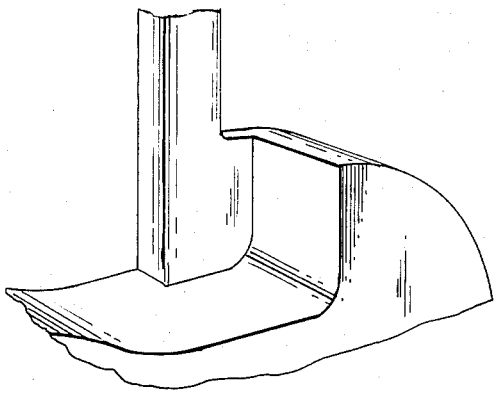
FIG. 16 is a pictorial view of the inventions neck-body interrelationship.

FIG. 16 illustrates the interaction more graphically.

It will be appreciated that a conventional electric guitar, where the body is constructed of a solid mass of wood or other material can have a neck joined to it in the manner described in FIGS. 6 through 10, where a mortise would be cut directly into the body.

Figure 17:
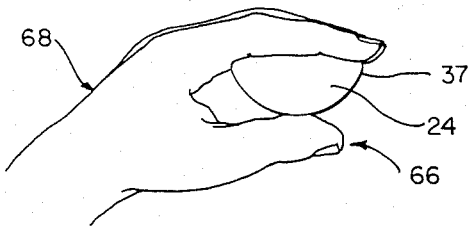
FIG. 17 is an end view of an instrument neck with a hand grasping it showing correct transverse placement of the thumb.

FIG. 17 is an end view of an instrument neck 24 with a hand grasping it showing correct transverse placement of the thumb. Note the tip of the thumb 66 is approximately three-fourths of the way across the neck toward the bass edge 37, and the wrist 68 is not bent.

Figure 18:
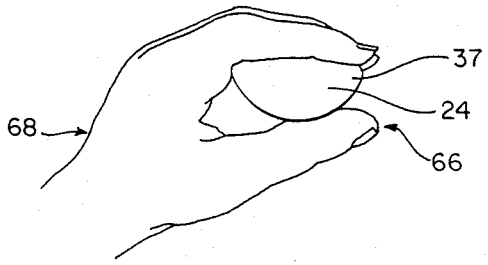
FIG. 18 is an end view of an instrument neck with a hand grasping it showing a common altered thumb placement.

FIG. 18 is an end view of an instrument neck 24 with a hand grasping it showing a common altered thumb placement. Note the tip of the thumb 66 extends slightly beyond the bass edge 37 of the neck, and the wrist 68 is bent.

Figure 19:
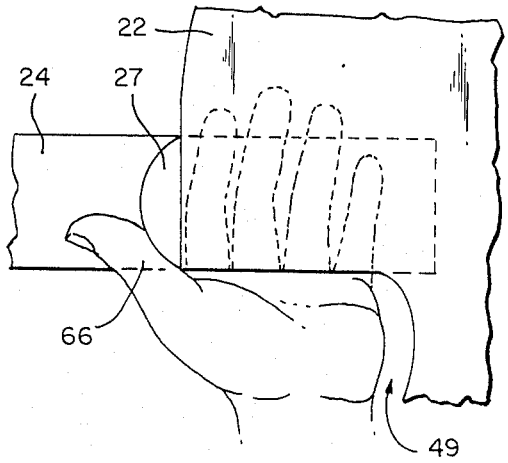
FIG. 19 PRIOR ART
FIG. 19 is a bottom plan detail showing the thumb of a hand forced out of proper position by the heel on a conventional instrumentn with a cutaway.

FIG. 19 is a botton plan detail showig a hand grasping a neck 24, in the area proximal to the body 22, on a conventional instrument having a cutaway 49, where the thumb 66 is forced out of proper position (violating rule E) by the heel 27.

Figure 20:
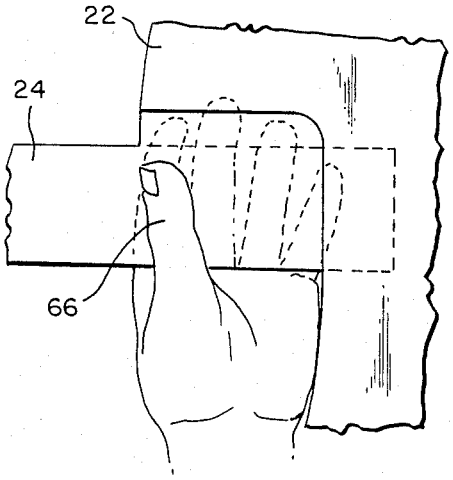
FIG. 20 is a bottom plan view detail showing the thumb in proper position on an instrument embodying the present invention.

FIG. 20 is a bottom plan detail showing a hand grasping a neck 24 in the area proximal to the body 22 on an instrument embodying the present invention. Note the thumb 66 is able to oppose the fingers with the proper relationship as regards rule E and F-the same coplanar opposition that would be possible on that portion of the neck which extends from the body.

Figure 21:
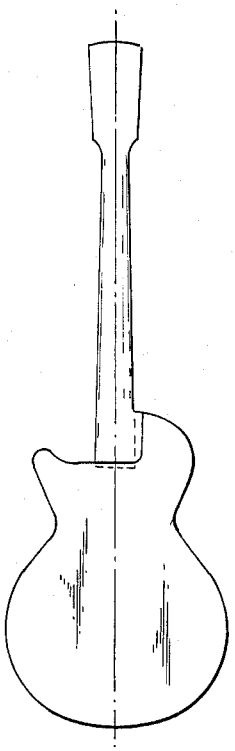
FIG. 21 is a bottom plan view of the prsent invention as applied to an electric guitar.

It will be understood that the electric guitar as shown in FIG. 21 utilizes the structure previously described.

Applicant's invention allows truly complete and unrestricted room for the thumb, so that the hand need not assume incorrect form or change position whatsoever in the upper fretboard.

Further, applicant is the only one to even suggest that a specific finger-thumb relationship will need to be maintained in order that facility and dexterity not be lost in the upper register of the instrument.

Thus as can be seen, applicant's invention is an important improvement for a number of reasons. The improved structure allows guitarists to better use the upper registers of the instrument. The structure also provides for a more stable, better supported fretboard. The desired results are achieved without compromising the acoustic qualities or the structural integrity of the instrument.

It will be apprciated that other variations and embodiments of the invention as applied to instruments within the family of stringed instruments are contemplated and that this description does not limit the scope of the invention as determined by the claims which follow.

I claim:

1. In an acoustic guitar having a hollow body consistingn of a soundboard, a back, and a side connecting said soundboard and back to enclose said hollow body; a neck including a head at one end, a heel portion at the other end, and a fingerboard secured to the upper surface of said neck betwteen said head and said heel portion; strings extending over said fingerboard and att least a portion of said body; and a heel connecting said neck with said hollow body, the improvement comprising:

said neck having a longitudinal axis dividing said neck into bass and treble halves, corresponding to the tuning of the strings extending thereover, said neck halves having corresponding bass and treble edges;

said heel being L-shaped when viewed in a cross-sectional plane parallel with said soundboard, said heel extending between and being connected to said soundboard and to said back, a first leg of said L extending transversely of said neck, and a second leg extending away from said first leg parallel to said neck axis, said second leg being spaced away from teh bass edge of said neck;

said neck having an integral heel portion extending outwardly parallel to said soundboard from said neck and joined at least to said second leg; and said side of said hollow body having opposite ends, both joining with either said neck or said heel in the vicinity of the free ends of said first and second legs.

2. The guitar of claim 1, wherein said neck heel portion and said heel consist of a complementary mating mortise and tenon joint.

3. The guitar of claim 1, wherein said heel is integral with said neck heel portion.

4. The guitar of claim 1, wherein said neck heel portion and said heel have complimentary mating surfaces.

5. The guitar of claim 1, wherein said fingerboard extends the full length of said neck from said head to said other end of said neck and said neck includes a truss rod extending from said head to said other end of said neck to support the entire length of said fingerboard.

6. The guitar of claim 5, wherein said lateral extension also joins with said first leg.

7. The guitar of claim 1, wherein said horizontally extending neck heel portion extends laterally outwardly to join with said second leg.

8. The guitar of claim 1, wherein said fingerboard extends the full length of said neck from said head to said other end of said neck, wherein the thickness of said neck from said head to said first leg is without sudden abrupt changes, and wherein said hollow body has a thickness less than said neck thickness, whereby a thumb receiving recess is provided under the neck coextensive with the body end of said fingerboard.

9. In a guitar including a body formed of one or more elements joined together, said body having an upper and lower surface: a neck including a head at one end, a heel portion at the other end, and a fingerboaord secured to the uppe surface of said neck between said head and said heel portion; strings extending over said fingerboard and at least a portion of said body; and a body heel portion joined with said neck heel portion connecting said neck to said body, the improvement comprising:

the neck having a longitudinal axis dividing said neck into bass and treble halves, corresponding to the tuning of othe strings extending thereover, said neck halves having corresponding bass and treble edges;

the body heel portion beingn L-shaped when viewed in a cross-sectional plane parallel with said body upper surface, the first leg of the body heel portion extending transversely of said neck and the second leg of the body heel portion extending away from said first leg toward the head of and parallel to said neck axis spaced from the bass edge of said neck;

said neck having an integral heel portion extending outwardly from said neck perpendicular to said neck, with its upper and lower surface substantially parallel to the finger board and having its outer edge substantially parallel to the edge of the neck and joined to at least said second leg of the body heel portion.

* * * * *